US009878862B2

(12) United States Patent
Maruta

(10) Patent No.: US 9,878,862 B2
(45) Date of Patent: Jan. 30, 2018

(54) IMAGE FORMING APPARATUS THAT ENABLES ADJUSTING PRESSURE BETWEEN FIXED GUIDE AND MOVABLE GUIDE

(71) Applicant: Kyocera Document Solutions Inc., Osaka (JP)

(72) Inventor: Masaaki Maruta, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/355,077

(22) Filed: Nov. 18, 2016

(65) Prior Publication Data

US 2017/0137244 A1 May 18, 2017

(30) Foreign Application Priority Data

Nov. 18, 2015 (JP) ..... 2015-225586

(51) Int. Cl.

*B65H 3/66* (2006.01)
*B65H 1/26* (2006.01)
*G03G 15/00* (2006.01)

(52) U.S. Cl.

CPC ..... *B65H 3/66* (2013.01); *B65H 1/266* (2013.01); *G03G 15/6502* (2013.01); *G03G 15/6511* (2013.01); *G03G 15/6529* (2013.01); *B65H 2402/341* (2013.01); *B65H 2404/144* (2013.01); *B65H 2404/1421* (2013.01); *B65H 2404/1442* (2013.01); *B65H 2404/1521* (2013.01); *B65H 2801/12* (2013.01)

(58) Field of Classification Search

CPC .. B65H 3/66; B65H 1/266; B65H 2404/1421; B65H 2404/144; B65H 2404/1442; B65H 2404/1521; B65H 2405/31; G03G 2215/00383

See application file for complete search history.

(56) References Cited

U.S. PATENT DOCUMENTS 8,764,006 B2 * 7/2014 Samoto ..... B41J 3/60 271/117
9,056,745 B2 * 6/2015 Harada ..... B65H 5/062
(Continued)

FOREIGN PATENT DOCUMENTS

JP 2001-301993 A 10/2001

*Primary Examiner* — Jeremy R Severson
(74) *Attorney, Agent, or Firm* — James Judge

(57) ABSTRACT

An image forming apparatus includes an apparatus main body, a sheet feed cassette, and a conveyance unit. The sheet feed cassette is attachably/detachably supported by the apparatus main body. The sheet feed cassette includes pressing portions provided on both sides thereof in the sheet width direction. The movable guide includes pressed portions provided on both sides thereof in the sheet width direction. By the pressed portions abutting on the pressing portions, the movable guide is pushed up by the sheet feed cassette, and the movable guide is positioned with respect to the fixed guide. The pressing portion provided on another side of the sheet feed cassette in the sheet width direction includes an adjusting mechanism that adjusts pressing force against the pressed portion provided on another side of the movable guide in the sheet width direction to enable adjustment of pressure abutment force between the conveyance rollers.

5 Claims, 14 Drawing Sheets

(56) References Cited

U.S. PATENT DOCUMENTS

| | | | | |
|---|---|---|---|---|
| 9,290,340 | B2 * | 3/2016 | Yamamoto | B65H 1/266 |
| 9,483,005 | B2 * | 11/2016 | Kobayashi | B65H 5/062 |
| 2015/0309460 | A1 * | 10/2015 | Yamamoto | B65H 1/266<br>271/3.19 |

* cited by examiner

IMAGE FORMING APPARATUS THAT ENABLES ADJUSTING PRESSURE BETWEEN FIXED GUIDE AND MOVABLE GUIDE

INCORPORATION BY REFERENCE

This application is based upon, and claims the benefit of priority from, corresponding Japanese Patent Application No. 2015-225586 filed in the Japan Patent Office on Nov. 18, 2015, the entire contents of which are incorporated herein by reference.

BACKGROUND

Unless otherwise indicated herein, the description in this section is not prior art to the claims in this application and is not admitted to be prior art by inclusion in this section.

A typical image forming apparatus, such as a copier and a printer, may be configured such that mounting an attachable/detachable sheet feed cassette pushes up a separation roller, which is supported by an apparatus main body, to be positionally aligned.

Another image forming apparatus may be configured such that mounting an attachable/detachable sheet feed cassette pushes up a duplex conveyance unit, which is supported by an apparatus main body, to be positionally aligned. The duplex conveyance unit includes a fixed guide and a movable guide. The fixed guide is secured to the apparatus main body. The movable guide is turnably supported below the fixed guide. This duplex conveyance unit allows a paper jam to be fixed such that the movable guide is turned downward after the sheet feed cassette is extracted, so as to cause a duplex conveying path to be opened.

This image forming apparatus includes a projection piece projecting downward and an abutment portion on which the projection piece is brought into abutment. The projection piece is formed on the movable guide, and the abutment portion is formed in the sheet feed cassette. Mounting the sheet feed cassette brings the abutment portion into abutment on the projection piece, so as to cause the movable guide to be lifted by the sheet feed cassette, thus positionally aligning the movable guide with respect to the fixed guide. Thus, the movable guide and the fixed guide are positionally aligned to cause respective conveyance rollers located in the movable guide and the fixed guide to be brought into abutment one another with appropriate pressure. This causes a paper sheet to be smoothly conveyed along the duplex conveying path.

SUMMARY

An image forming apparatus according to one aspect of the disclosure includes an apparatus main body, a sheet feed cassette, and a conveyance unit. The sheet feed cassette is attachably/detachably supported by the apparatus main body. The conveyance unit includes a conveying path formed above the sheet feed cassette. The conveying path conveys sheet in a predetermined direction. The conveyance unit includes a fixed guide, a movable guide, and conveyance rollers. The fixed guide is secured to the apparatus main body. The movable guide is turnably supported around one end thereof in a sheet conveyance direction below the fixed guide. The conveyance rollers are provided in each of the fixed guide and the movable guide. The conveyance rollers rotate in pressure abutment with the one another to convey sheet along the conveying path. The conveying path is provided to be openable by the movable guide being turned downward after the sheet feed cassette is extracted from the apparatus main body. The fixed guide includes an engaged portion provided on one side of the conveyance unit in a sheet width direction intersecting the conveyance direction. The movable guide includes an engaging portion engageable with the engaged portion provided on the one side of the movable guide in the sheet width direction. The sheet feed cassette includes a first and a second pressing portions provided on both sides thereof in the sheet width direction. The movable guide further includes a first and a second pressed portions provided on both sides thereof in the sheet width direction. By the first and the second pressed portions abutting on the first and the second pressing portions, the movable guide is pushed up by the sheet feed cassette, and the movable guide is positionally aligned with respect to the fixed guide. The second pressing portion is provided on another side of the sheet feed cassette in the sheet width direction and includes an adjusting mechanism that adjusts pressing force against the second pressed portion to enable adjustment of pressure abutment force between the conveyance rollers.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
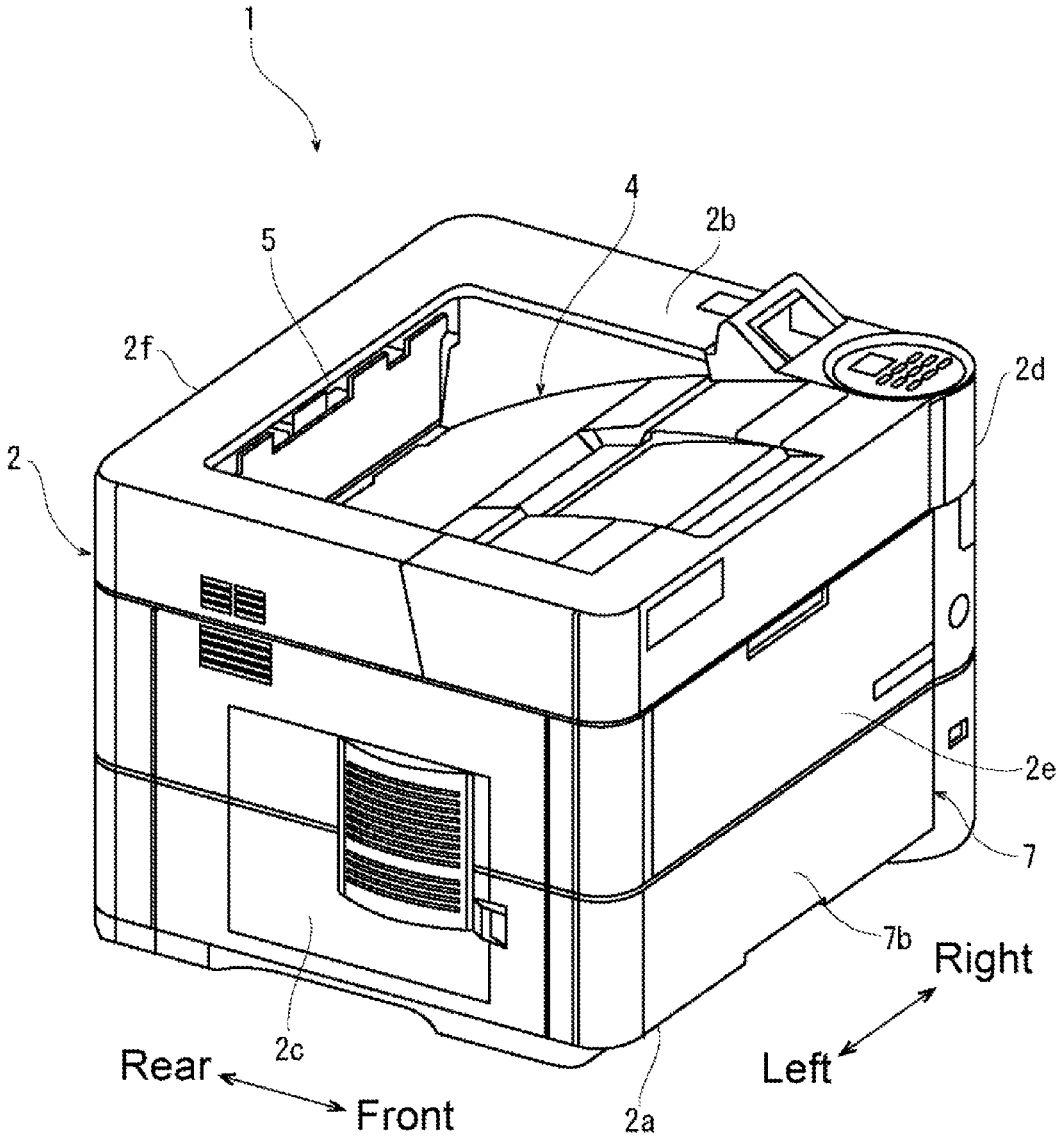
FIG. 1 obliquely illustrates a printer according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus according to one embodiment of the disclosure with reference to the drawings.

Figure 2:
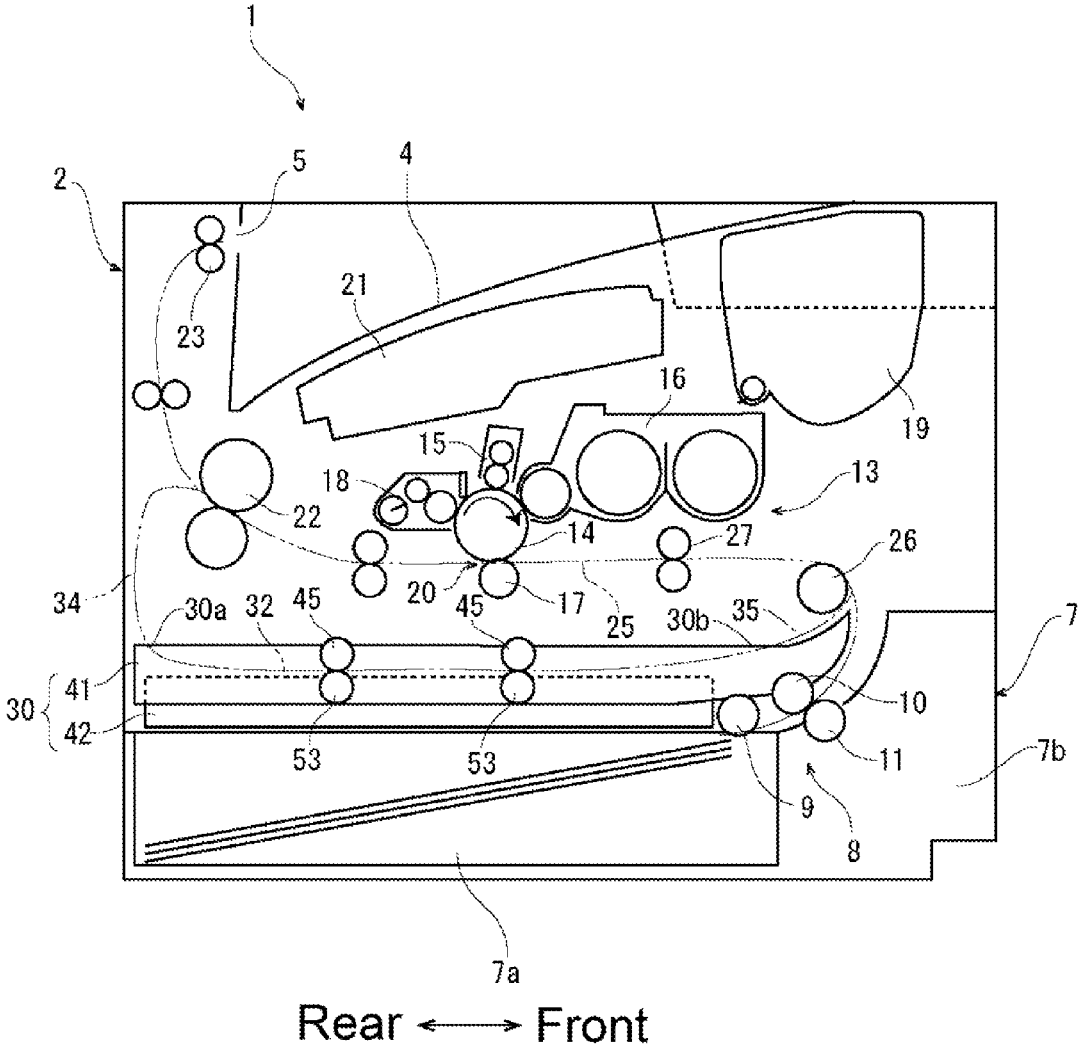
FIG. 2 schematically illustrates an internal configuration of the printer according to the one embodiment.

First, with reference to FIGS. 1 and 2, the following describes an overall configuration of a printer 1 as the image forming apparatus according to the embodiment. FIG. 1 obliquely illustrates the printer 1. FIG. 2 schematically illustrates an internal configuration of the printer 1. In the following description, a front-rear direction and a lateral direction indicate a front-rear direction and a lateral direction, which are illustrated in FIG. 1.

The printer 1 includes an apparatus main body 2 having a box shape. The apparatus main body 2 includes a hollow portion surrounded with a bottom plate 2*a*, a top panel 2*b*, a left side plate 2*c*, a right side plate 2*d*, a front side plate 2*e*, and a rear side plate 2*f*. The top panel 2*b* includes a sheet discharge tray 4 inclined upward toward a front from a rear. At a rear of the sheet discharge tray 4, a sheet discharge exit 5 is formed.

The hollow portion has a lower portion housing a sheet feed cassette 7 that houses paper sheets. The sheet feed cassette 7 includes a housing portion 7*a* and a front wall portion 7*b*. The housing portion 7*a* houses the paper sheets. The front wall portion 7*b* includes a lower portion of the front side plate 2*e* of the apparatus main body 2. Sliding the sheet feed cassette 7 in the front-rear direction ensures the sheet feed cassette 7 to be attachable/detachable to/from the apparatus main body 2. Above a front of the sheet feed cassette 7, a paper feeder 8 that feeds the paper sheet from the sheet feed cassette 7 is located. The paper feeder 8 includes a pickup roller 9, a feed roller 10, and a retard roller 11 opposed to the feed roller 10.

Above the sheet feed cassette 7, an image forming unit 13 is located. In the image forming unit 13, a photoreceptor drum 14 is rotatably located. A charger 15, a developing device 16, a transfer roller 17, and a cleaning apparatus 18 are located around the photoreceptor drum 14 along a rotation direction of the photoreceptor drum 14. Above the developing device 16, a toner container 19 is attachably/detachably mounted. Between the transfer roller 17 and the photoreceptor drum 14, a transfer nip 20 is formed. Above the image forming unit 13, an exposure device 21 constituted of a laser scanning unit (LSU) is located. Furthermore, behind the image forming unit 13, a fixing unit 22 is located, and above the fixing unit 22, a discharge unit 23 facing the sheet discharge exit 5 is located.

The apparatus main body 2 internally includes a main conveying path 25. The main conveying path 25 is a path for the paper sheet conveyed toward the discharge unit 23 after the paper sheet passes through the transfer nip 20 and the fixing unit 22 from the paper feeder 8. In the main conveying path 25, a conveyance roller 26 is located in a downstream side of the paper feeder 8, and a registration roller pair 27 is located in a downstream side of the conveyance roller 26.

Furthermore, between the sheet feed cassette 7 and the image forming unit 13, a duplex conveyance unit 30 is located. In the duplex conveyance unit 30, a duplex conveying path 32 is formed. The duplex conveying path 32 is provided toward an outlet 30*b* formed in a front end portion of the duplex conveyance unit 30 from an inlet 30*a* formed in a rear end portion of the duplex conveyance unit 30. The duplex conveyance unit 30 includes the inlet 30*a* connected to a branch path 34 branching from the main conveying path 25 in a downstream side of the fixing unit 22. The duplex conveyance unit 30 further includes the outlet 30*b* connected to a connecting path 35 connecting to the main conveying path 25 in an upstream side of the conveyance roller 26.

Next, the following describes an image forming operation of the printer 1 having such configuration. In the image forming unit 13, after the charger 15 charges a surface of the photoreceptor drum 14, a laser beam from the exposure device 21 exposes the photoreceptor drum 14 corresponding to image data to form an electrostatic latent image on the surface of the photoreceptor drum 14. The developing device 16 develops the electrostatic latent image into a toner image.

ON the other hand, after the paper sheet conveyed from the sheet feed cassette 7 by the paper feeder 8 is conveyed to the transfer nip 20 along the main conveying path 25 in accordance with timing of the above-described image forming operation, the toner image on the photoreceptor drum 14 is transferred onto the paper sheet in the transfer nip 20. Subsequently, the paper sheet onto which the toner image has been transferred is conveyed to a downstream side of the main conveying path 25. After the paper sheet is conveyed into the fixing unit 22, the fixing unit 22 fixes the toner image on the paper sheet. The paper sheet onto which the toner image has been fixed passes through the sheet discharge exit 5 from the discharge unit 23 to be discharged to the sheet discharge tray 4. The cleaning apparatus 18 removes remaining toner on the photoreceptor drum 14.

When performing duplex printing, the paper sheet, on one surface of which the toner image is formed after the paper sheet has passed through the fixing unit 22, is reversely conveyed after the discharge unit 23 discharges a front end portion of the paper sheet from the sheet discharge exit 5. Then, a rear end portion of the paper sheet passes through the branch path 34 first, which causes the paper sheet to be conveyed to the duplex conveying path 32. A branch guide (not illustrated) is located in a downstream side in a conveyance direction of the fixing unit 22. The branch guide guides the front end portion of the paper sheet to the sheet discharge exit 5 during ordinary printing, and guides the rear end portion of the paper sheet to the branch path 34 during duplex printing. Subsequently, the paper sheet passes through the connecting path 35 to be conveyed along the main conveying path 25 again, and the image forming unit 13 similarly forms a toner image on the other surface. Then, after the fixing unit 22 fixes the toner image, the discharge unit 23 discharges the paper sheet to the sheet discharge tray 4.

Figure 3:
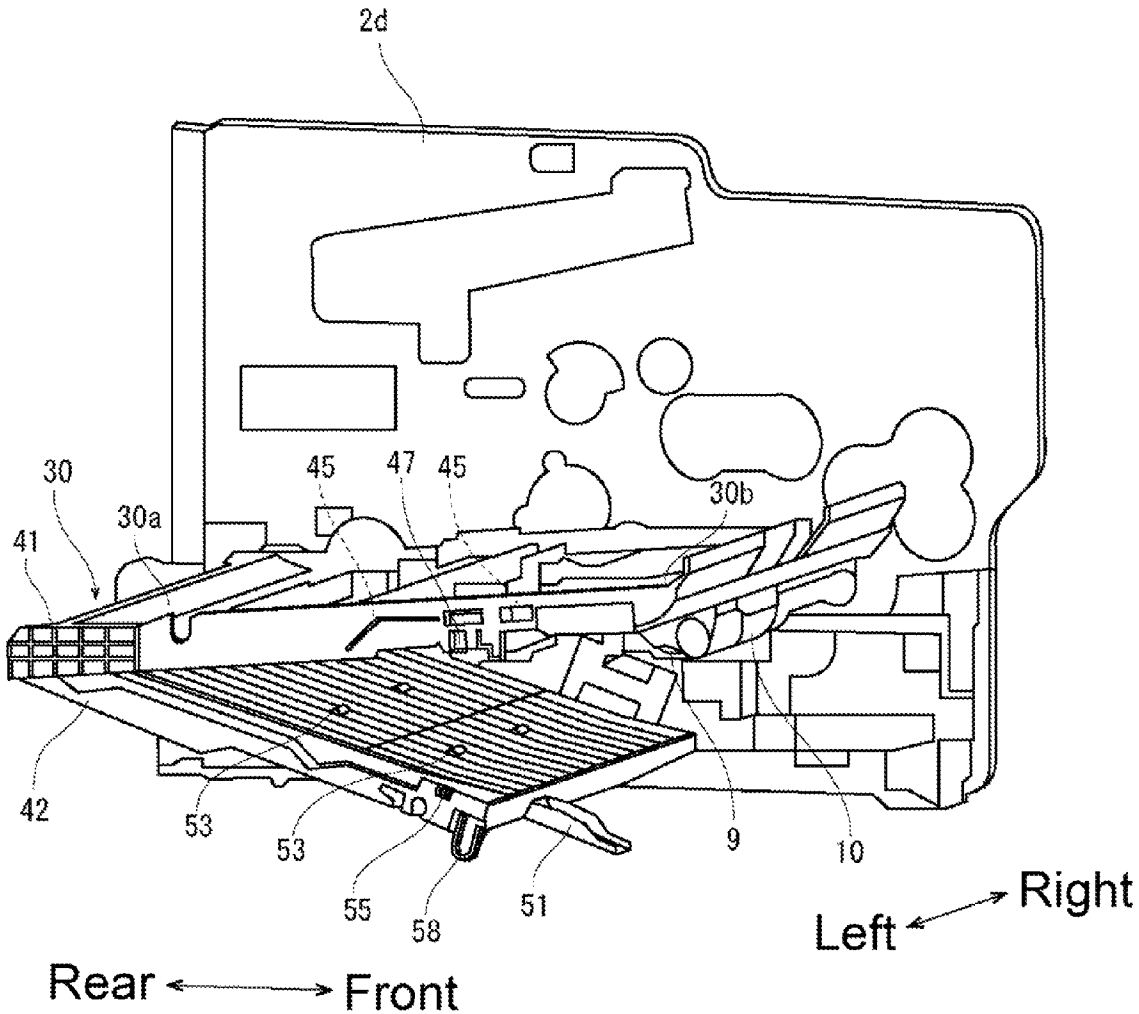
FIG. 3 obliquely illustrates a duplex conveyance unit in the printer according to the one embodiment.
Figure 4:
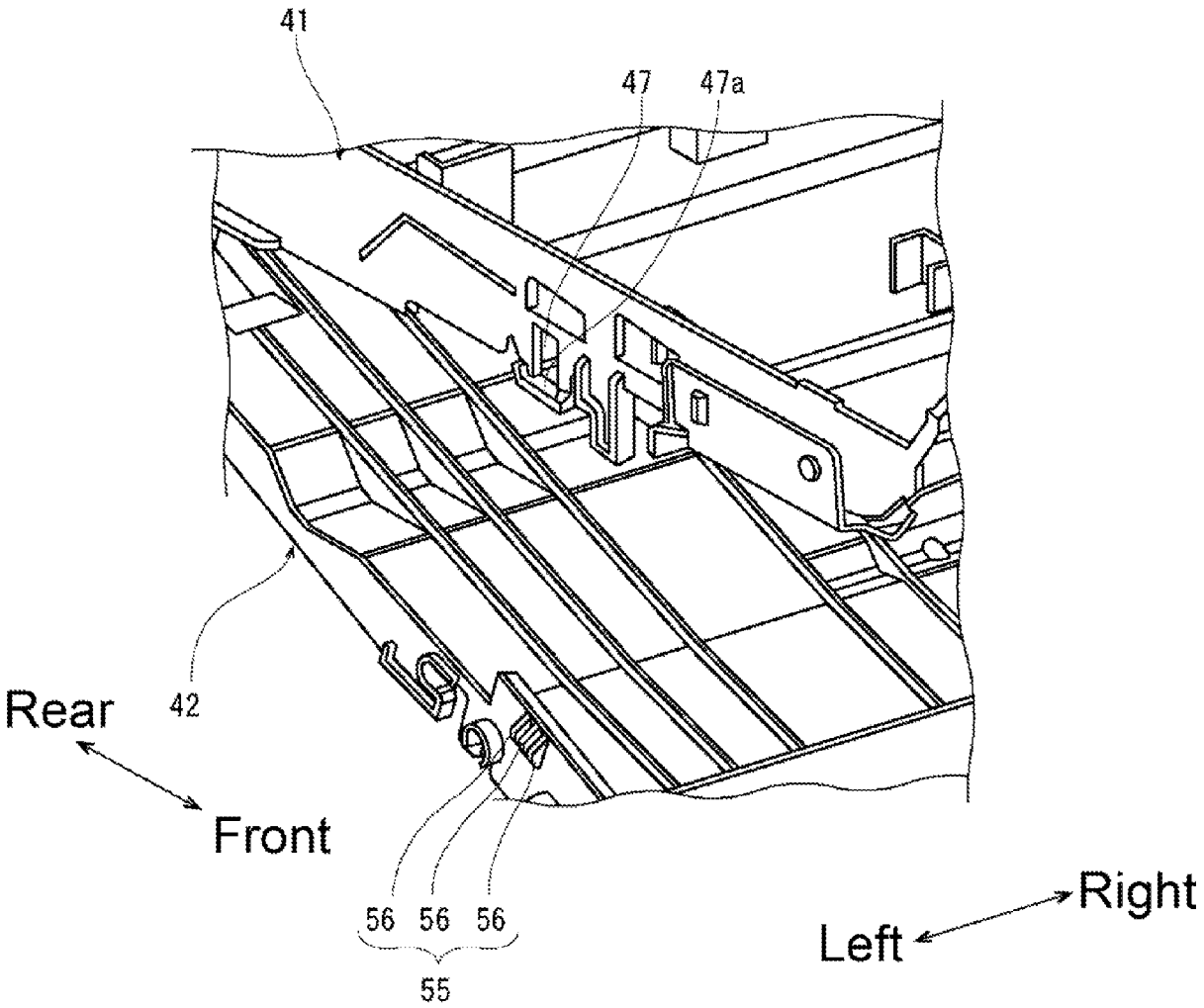
FIG. 4 obliquely illustrates engaging portions of a fixed guide and a movable guide of the duplex conveyance unit in the printer according to the one embodiment.
Figure 5:
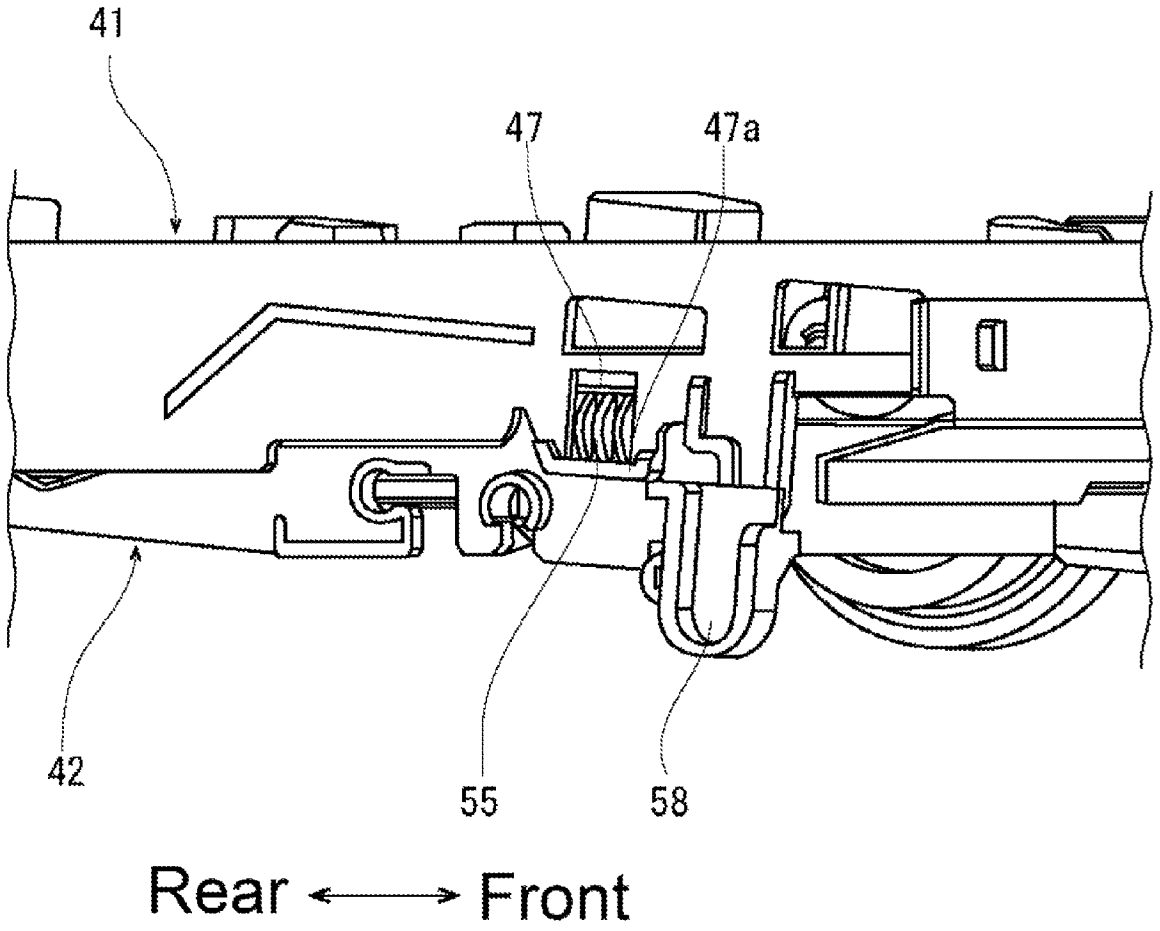
FIG. 5 obliquely illustrates the engaging portions of the fixed guide and the movable guide of the duplex conveyance unit in a state where the engaging portions engage one another in the printer according to the one embodiment.
Figure 6:
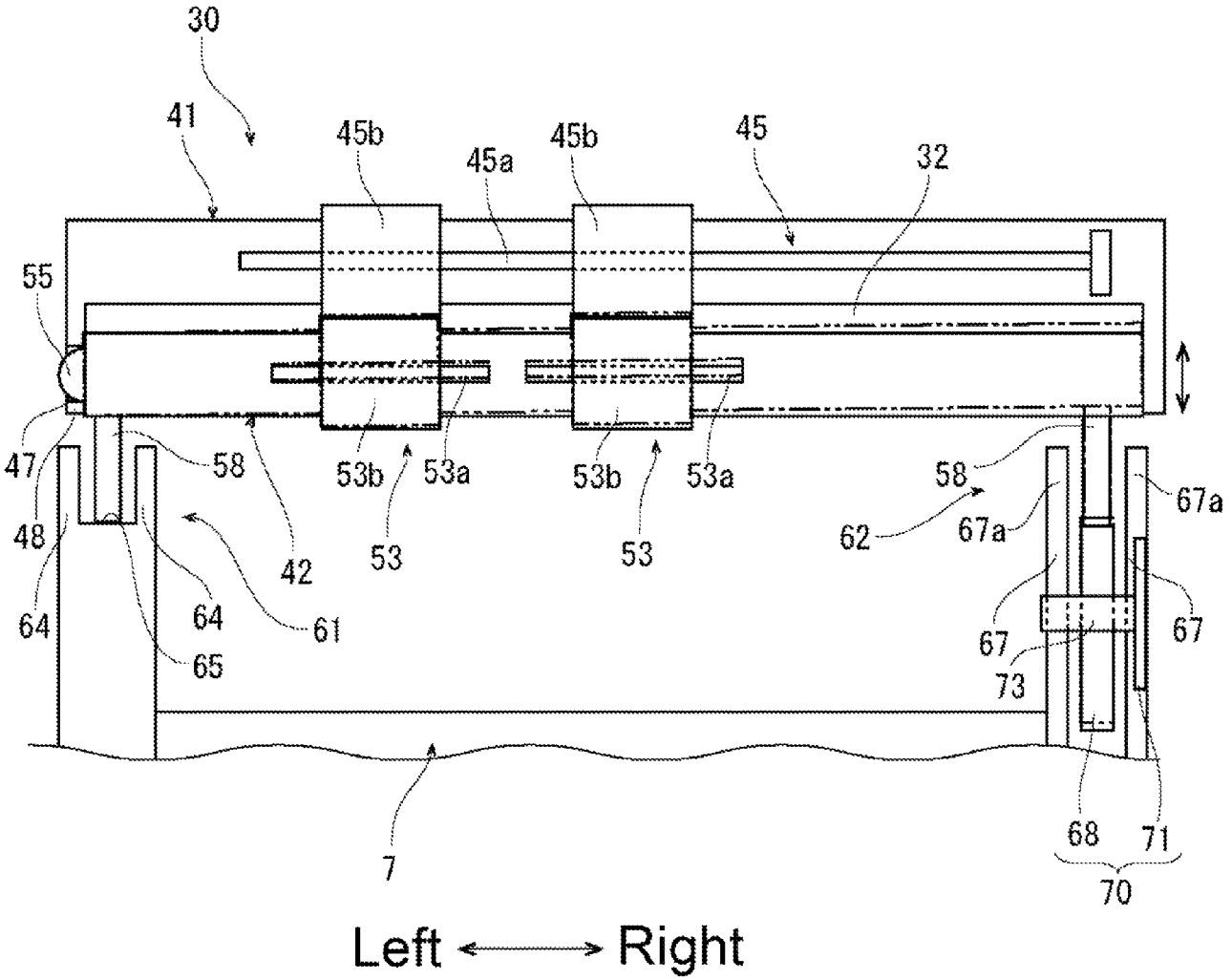
FIG. 6 schematically illustrates the movable guide of the duplex conveyance unit and pressing portions of a sheet feed cassette in the printer according to the one embodiment.

Next, with reference to FIGS. 2 to 6, the following describes the duplex conveyance unit 30. FIG. 3 obliquely illustrates the duplex conveyance unit 30. FIG. 4 obliquely illustrates engaging portions formed on a fixed guide 41 and a movable guide 42. FIG. 5 obliquely illustrates the engaging portion of the fixed guide 41 and the engaging portion of the movable guide 42 in a state where the engaging portions engage one another. FIG. 6 schematically illustrates the duplex conveyance unit 30 from a front side.

As illustrated in FIG. 3, the duplex conveyance unit 30 includes the fixed guide 41 and the movable guide 42, which have plate shapes. The fixed guide 41 has a rear end portion on which the inlet 30*a* (see also FIG. 7) of the paper sheet is formed along a paper sheet width direction orthogonal to a paper sheet conveyance direction. The fixed guide 41 has a front end portion on which the outlet 30*b* of the paper sheet is formed along the paper sheet width direction. The fixed guide 41 has an inferior surface on which the pickup roller 9 and the feed roller 10, which are in the paper feeder 8, are rotatably supported on the front with respect to the outlet 30*b*. Furthermore, the fixed guide 41 has the inferior surface at which a pair of spindles (not illustrated) is formed on a rear with respect to the inlet 30*a*. The pair of the spindles is coaxially formed along the paper sheet width direction on both end portions of the paper sheet width direction.

In the fixed guide 41, a drive roller 45 is supported to project toward the duplex conveying path 32 and rotate. As schematically illustrated in FIG. 6, the drive roller 45 includes a rotation shaft 45*a* and two roller portions 45*b*. The two roller portions 45*b* are circularly located on the rotation shaft 45*a* at a predetermined interval. The drive roller 45 is located near the center in the conveyance direction of the fixed guide 41, and the rotation shaft 45*a* has a right end portion connecting to a driving source (not illustrated).

Furthermore, as illustrated in FIG. 4, the fixed guide 41 has the front end portion, on which an opening 47 with a rectangular shape as an engaged portion for the movable guide 42, is formed on a side surface of one end side (left side) in the paper sheet width direction.

As illustrated in FIG. 3, the fixed guide 41 is secured to the left side plate (not illustrated) and the right side plate 2*d* of the apparatus main body 2 above the sheet feed cassette 7.

As illustrated in FIG. 3, a front end surface of the movable guide 42 has a left end portion on which a handle 51 extends ahead and runs. The movable guide 42 has a rear end portion where a pair of bearing portions (not illustrated) is formed. The pair of the bearing portions is pivotally supported by the pair of the spindles formed on the fixed guide 41. The pair of the bearing portions is coaxially formed extending along the paper sheet width direction on both the end portions of the paper sheet width direction.

Furthermore, two driven rollers 53 are supported to project to the duplex conveying path 32 and to rotate on the movable guide 42. As illustrated in FIG. 6, the driven rollers 53 each include a rotation shaft 53*a* and a roller portion 53*b* circularly located on the rotation shafts 53*a*. The roller portions 53*b* are located corresponding to the respective roller portions 45*b* of the drive roller 45 supported by the fixed guide 41.

Furthermore, as illustrated in FIG. 4, the movable guide 42 has a side surface, on which a protrusion 55 is formed as an engaging portion for the fixed guide 41, on one end side (a left side) in the paper sheet width direction. The protrusion 55 is constituted of three projection pieces 56 arranged in the conveyance direction. The three projection pieces 56 have an arc shape in side view projecting toward outer direction.

As illustrated in FIGS. 3 and 5, the movable guide 42 has right and left side surfaces, on which right and left projection pieces 58 as pressed portions to be pushed up by the sheet feed cassette 7 are perpendicularly located at front with respect to the protrusion 55, respectively. The right and left projection pieces 58 have lower end portions curved in arc shapes with predetermined widths. The lower end portions of the right and left projection pieces 58 project downward with respect to an inferior surface of the movable guide 42.

The bearing portions, which are located in the rear end portion of the movable guide 42, are pivotally supported by the respective spindles of the fixed guide 41. This causes the movable guide 42 to be turnably supported with respect to the fixed guide 41. Holding the handle 51 to turn the movable guide 42 in an upper direction brings the protrusion 55 formed on the movable guide 42 into abutment on a lower edge portion 47*a* of the opening 47 on the fixed guide 41. After that, the protrusion 55 is internally pressed by the lower edge portion 47*a*, which causes an elastic deformation of the protrusion 55. Then, as illustrated in FIG. 5, the protrusion 55 engages the opening 47. On the other hand, after the sheet feed cassette 7 is extracted from the apparatus main body 2, holding the handle 51 to turn the movable guide 42 downward presses the protrusion 55 with the lower edge portion 47*a*, which causes the protrusion 55 to be elastically deformed to separate the protrusion 55 from the opening 47. Thus, the duplex conveying path 32 is opened.

Figure 7:
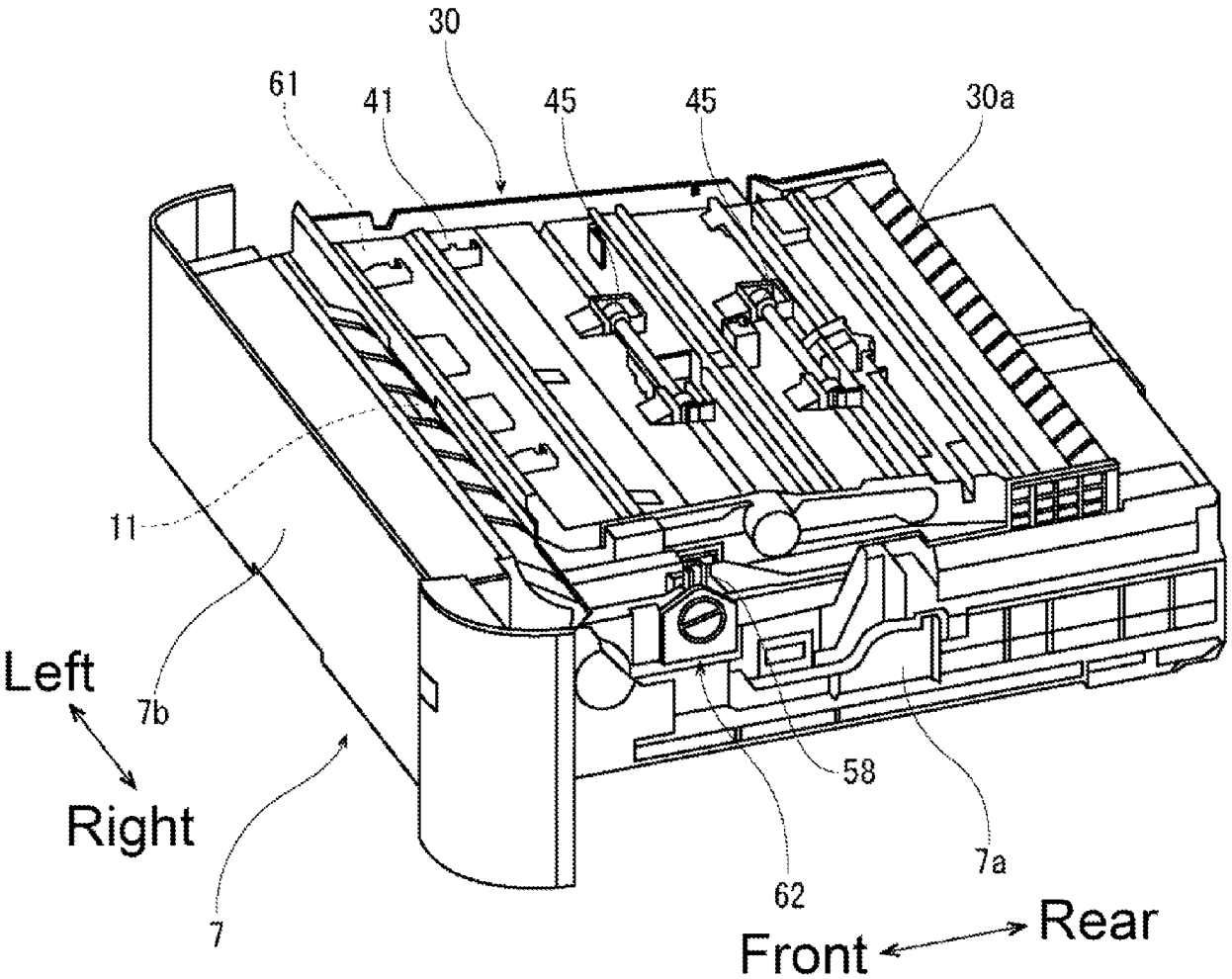
FIG. 7 obliquely illustrates the sheet feed cassette in the printer according to the one embodiment.
Figure 8:
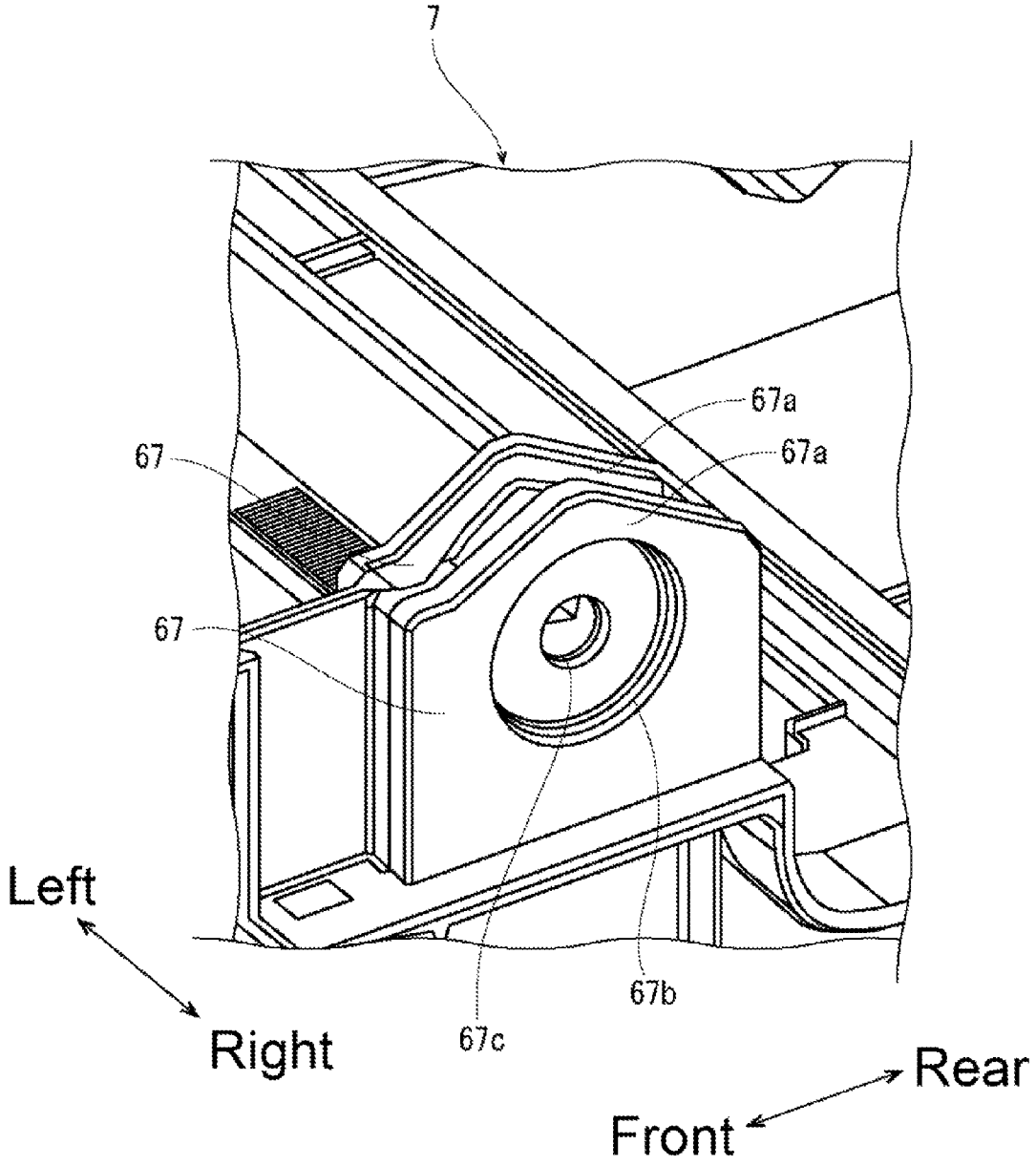
FIG. 8 obliquely illustrates inner and outer sidewall portions in the right pressing portion of the sheet feed cassette in the printer according to the one embodiment.
Figure 9:
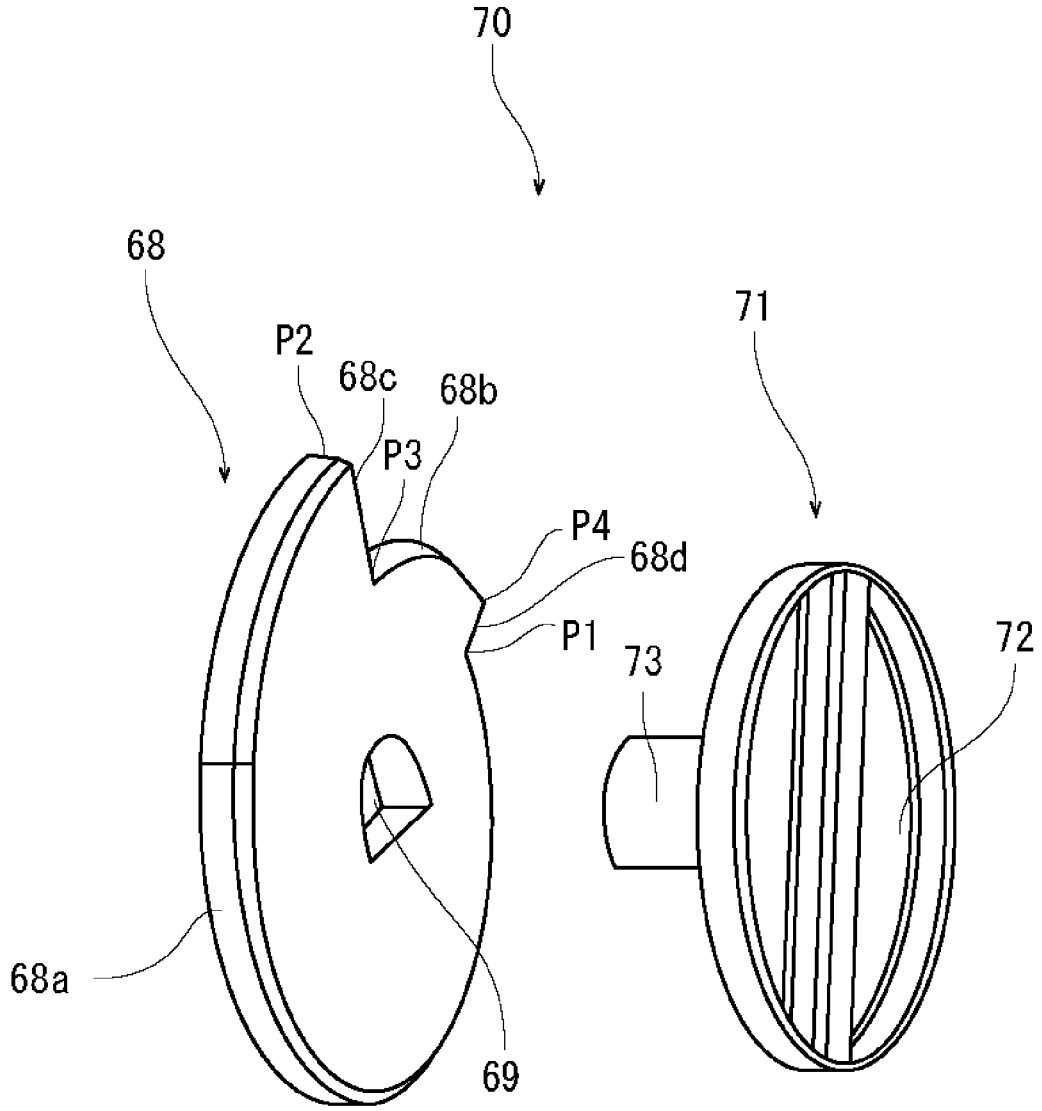
FIG. 9 obliquely illustrates an eccentric cam and an operation member in the right pressing portion of the sheet feed cassette in the printer according to the one embodiment.

Next, with reference to FIGS. 6 to 9, the following describes the sheet feed cassette 7. FIG. 7 obliquely illustrates the sheet feed cassette 7. FIG. 8 obliquely illustrates inner and outer sidewall portions 67 (also referred to as supporting portion) of a right pressing portion 62 (second pressing portion). FIG. 9 illustrates an exploded perspective view illustrating an eccentric cam 68 of the right pressing portion 62. In FIG. 7, the duplex conveyance unit 30 is illustrated above the sheet feed cassette 7.

As illustrated in FIG. 7, the housing portion 7*a* of the sheet feed cassette 7 has a front end portion where the retard roller 11 (see also FIG. 2) of the paper feeder 8 is rotatably supported. When the sheet feed cassette 7 is mounted in the apparatus main body 2, the retard roller 11 is opposed to the feed roller 10 supported by the fixed guide 41 in the duplex conveyance unit 30.

The housing portion 7*a* has right and left side plates at which the right pressing portion 62 and a left pressing portion 61 are formed at front end portions of top surfaces in the housing portion 7*a*. The right pressing portion 62 and the left pressing portion 61 are brought into abutment on the right and left projection pieces 58 located in the movable guide 42 to push up the right and left projection pieces 58, respectively.

As illustrated in FIG. 6, the left pressing portion 61 (first pressing portion) includes an abutting surface 65 and inner and outer sidewall portions 64. The left projection piece 58 is brought into abutment on the abutting surface 65. The abutting surface 65 has a planar shape with a predetermined length and is formed along the paper sheet conveyance direction. The inner and outer sidewall portions 64 are located upright on the abutting surface 65 and are located at predetermined intervals in the lateral direction. The inner and outer sidewall portions 64 have a triangular shape in plan view.

As illustrated in FIG. 6, the right pressing portion 62 includes the eccentric cam 68 (see FIG. 9) as a pressing force adjusting mechanism 70, and the inner and outer sidewall portions 67 (see FIG. 8). The pressing force adjusting mechanism 70 adjusts pressing force against the right projection piece 58. The inner and outer sidewall portions 67 rotatably support the eccentric cam 68.

As illustrated in FIG. 9, the eccentric cam 68 includes a first outer peripheral surface 68*a* and a second outer peripheral surface 68*b*, which have predetermined widths. The eccentric cam 68 has a D cutout 69 on its the center. The first outer peripheral surface 68*a* is formed along a circumferential direction from the minimum diameter position P1 with the smallest radius, which is a radius from the center of the D cutout 69, to the maximum diameter position P2 with the largest radius. The first outer peripheral surface 68*a* is gradually and radially expanded. The second outer peripheral surface 68*b* is formed along a circumferential direction from a position P3 with a radius larger than the minimum diameter position P1 to a position P4 with a radius smaller than the maximum diameter position P2. The second outer peripheral surface 68*b* is gradually and radially expanded. The first outer peripheral surface 68*a* is formed along approximately 4/5 of an outer peripheral surface of the eccentric cam 68, and the second outer peripheral surface 68*b* is formed along approximately 1/5 of the outer peripheral surface of the eccentric cam 68. The eccentric cam 68 further includes inclined surfaces 68*c* and 68*d* that extend in an approximately radial direction. The inclined surface 68*c* connects between the maximum diameter position P2 on the first outer peripheral surface 68*a* and the position P3 on the second outer peripheral surface 68*b*. The inclined surface 68*d* connects between the position P4 on the second outer peripheral surface 68*b* and the minimum diameter position P1 on the first outer peripheral surface 68*a*.

As illustrated in FIG. 8, the inner and outer sidewall portions 67 are located upright at predetermined intervals in the lateral direction. The inner and outer sidewall portions 67 have upper end portions 67*a* (also referred to as regulating portions) each formed in a triangular shape in side view. The outer sidewall portion 67 has an outer surface with a circular-shaped concave portion 67*b*. The concave portion 67*b* has the center on which a shaft hole 67*c* is formed to extend in the paper sheet width direction. The inner sidewall portion 67 has a shaft hole 67*c* coaxial with the shaft hole 67*c* of the outer sidewall portion 67.

The eccentric cam 68 is supported between the inner and outer sidewall portions 67 by an operation member 71. The operation member 71 includes a handle portion 72 and a spindle portion 73. The handle portion 72 has a disk shape. The spindle portion 73 is located upright on the center of the handle portion 72. The spindle portion 73 has a D-shaped cross section and is engageable with the D cutout 69 on the eccentric cam 68. After the spindle portion 73 in the operation member 71 passes through the D cutout 69 on the eccentric cam 68 through the shaft hole 67*c* of the outer sidewall portion 67, the spindle portion 73 passes through the shaft hole 67*c* of the inner sidewall portion 67 to prevent the spindle portion 73 from falling out. This causes the eccentric cam 68 to be supported between the inner and outer sidewall portions 67 and to be rotatable about the spindle portion 73 by the operation member 71. The outer sidewall portion 67 includes the concave portion 67*b* that houses the handle portion 72 on the operation member 71. During a normal operation, the eccentric cam 68 is supported by the operation member 71 such that the second outer peripheral surface 68*b* becomes the top surface. The inner and outer sidewall portions 67 have the upper end portions 67*a* projecting upward with respect to the eccentric cam 68.

Figure 10:
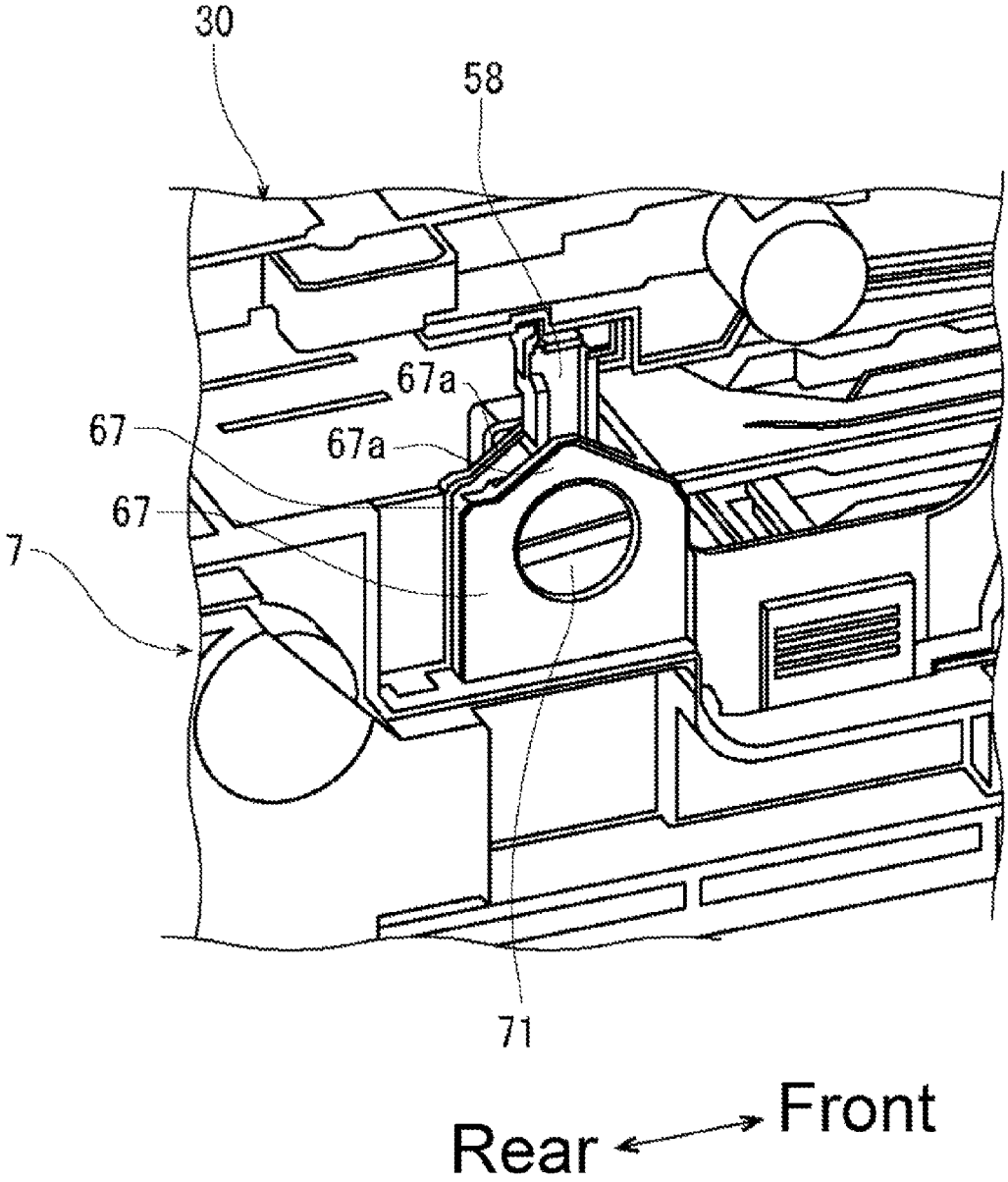
FIG. 10 obliquely illustrates a projection piece of the movable guide in a state where the projection piece is in abutment on the pressing portion of the sheet feed cassette in the printer according to the one embodiment.
Figure 11:
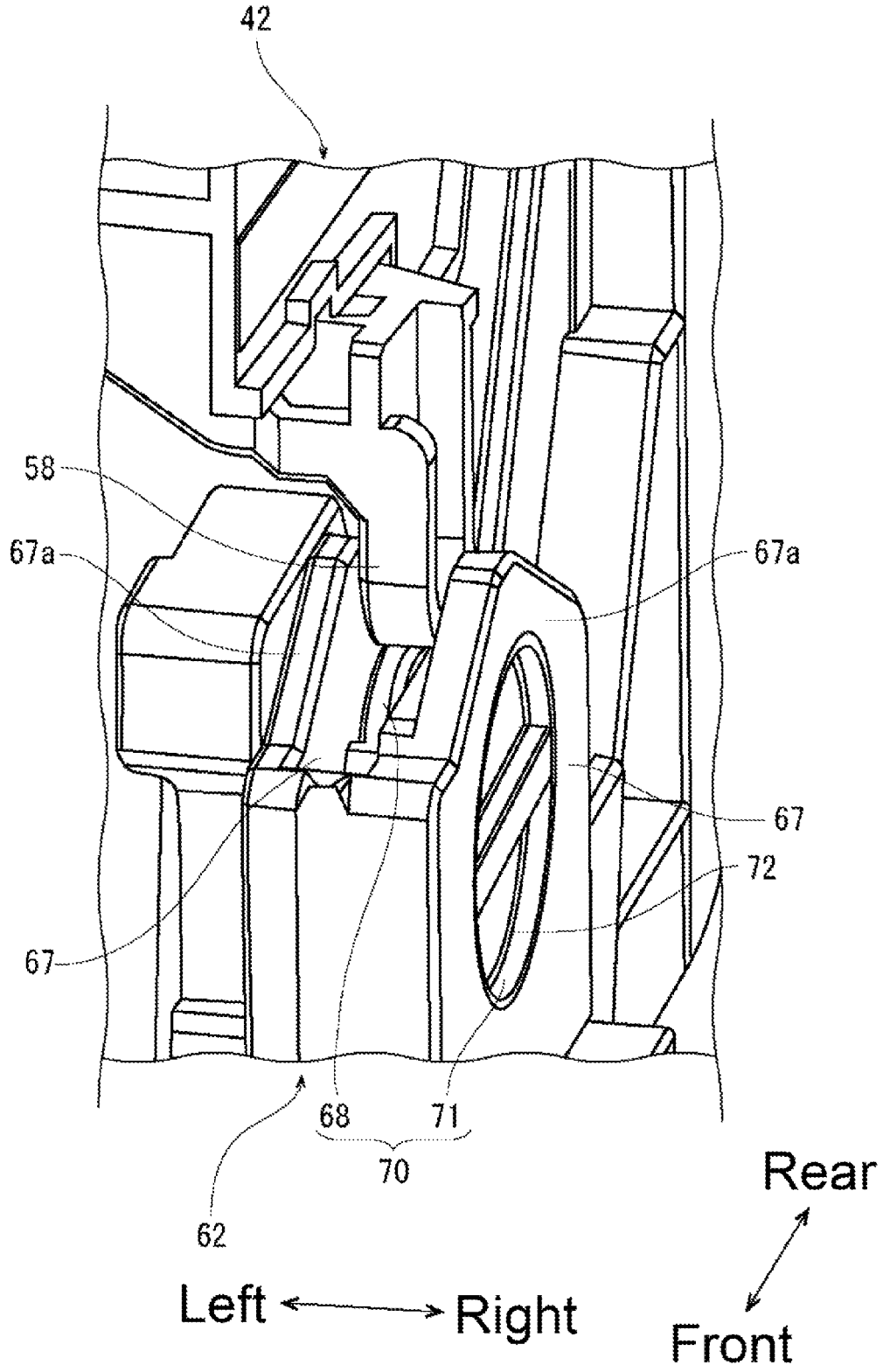
FIG. 11 obliquely illustrates the projection piece of the movable guide in a state where the projection piece is in abutment on the pressing portion of the sheet feed cassette in the printer according to the one embodiment.

The following describes a mounted state of the duplex conveyance unit 30 and the sheet feed cassette 7 in the printer 1 with the above-described configuration with reference to FIGS. 6, 10 and 11. FIGS. 10 and 11 obliquely illustrate the right pressing portion 62.

When the sheet feed cassette 7 is mounted in the apparatus main body 2 after the protrusion 55 of the movable guide 42 in the duplex conveyance unit 30 is engaged with the opening 47 on the fixed guide 41, the right and left pressing portions 62 and 61, which are formed in the sheet feed cassette 7, are brought into abutment on the respective right and left projection pieces 58, which are formed on the movable guide 42 in the duplex conveyance unit 30, from a lower side. That is, as illustrated in, FIG. 6, in the left pressing portion 61, a lower end surface on the left projection piece 58 in the movable guide 42 is brought into abutment on the abutting surface 65 located between the inner and outer sidewall portions 64. On the other hand, in the right pressing portion 62, as also illustrated in FIGS. 10 and 11, a lower end surface of the right projection piece 58 is brought into abutment on the second outer peripheral surface 68*b* in the eccentric cam 68, which is located between the inner and outer sidewall portions 67, so as to cause the lower end surfaces of the right and left projection pieces 58 to have the identical height. Assume that the height of the lower end surfaces of the right and left projection pieces 58 at this time is a normal height.

Thus, the right and left projection pieces 58 are brought into abutment on the right and left pressing portions 62 and 61, respectively. This causes the movable guide 42 to be pushed up by the sheet feed cassette 7, thus positionally aligning the movable guide 42 with respect to the fixed guide 41. The sheet feed cassette 7 is positionally aligned in the apparatus main body 2 with high accuracy to ensure paper feeding performance of the paper feeder 8. This also ensures the positionally aligning of the movable guide 42 with high accuracy due to the pushing up by the sheet feed cassette 7. As illustrated in FIG. 6, this causes the respective roller portions 45*b* of the drive roller 45, which are supported by the fixed guide 41, and the respective roller portions 53*b* of the driven rollers 53, which are supported by the movable guide 42, to be brought into pressure abutment with an appropriate pressure. This ensures the conveyance of the paper sheets in the duplex conveying path 32.

As described above, in the right pressing portion 62, the lower end surface of the right projection piece 58 in the movable guide 42 is brought into abutment on the second outer peripheral surface 68*b* in the eccentric cam 68 one another. Since the eccentric cam 68 is rotatably supported by the operation member 71 between the inner and outer sidewall portions 67, holding the handle portion 72 on the operation member 71 to rotate the spindle portion 73 rotates the eccentric cam 68 along with the operation member 71. Then, this moves a position on which the lower end surface of the right projection piece 58 is brought into abutment along the circumferential direction, thus changing the height of the lower end surface of the right projection piece 58.

Figure 12:
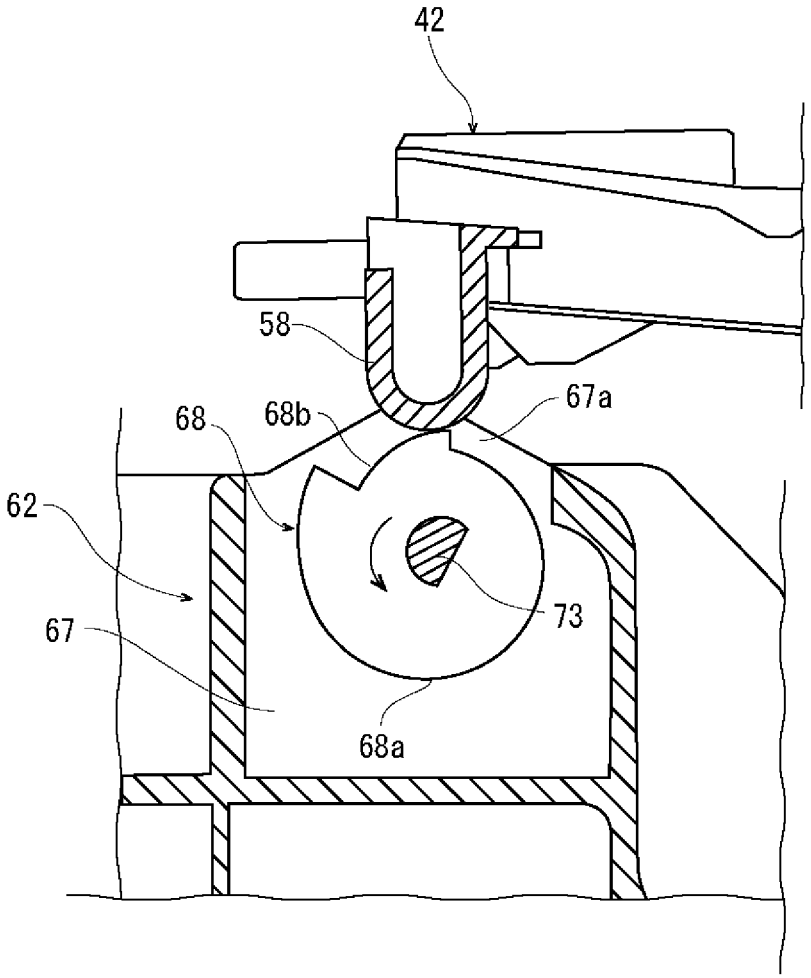
FIG. 12 illustrates the pressing portion of the sheet feed cassette and the projection piece of the movable guide in a state where the pressing portion and the projection piece are in abutment one another in the printer according to the one embodiment.
Figure 13:
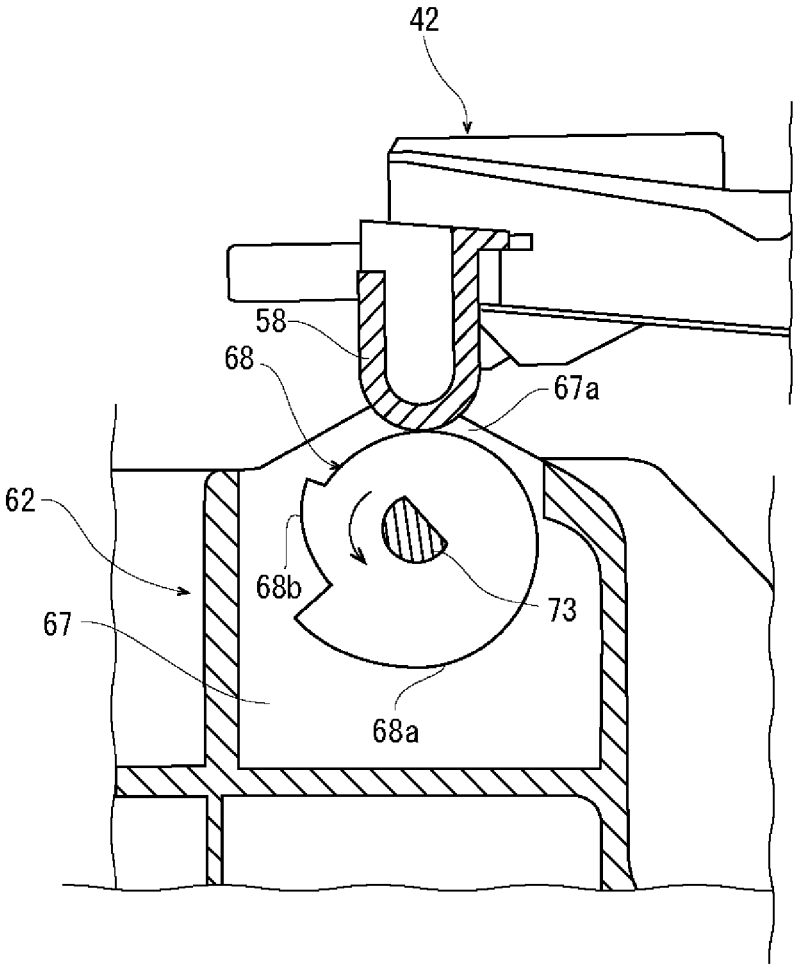
FIG. 13 illustrates the projection piece of the movable guide moved downward by the pressing portion of the sheet feed cassette in the printer according to the one embodiment.
Figure 14:
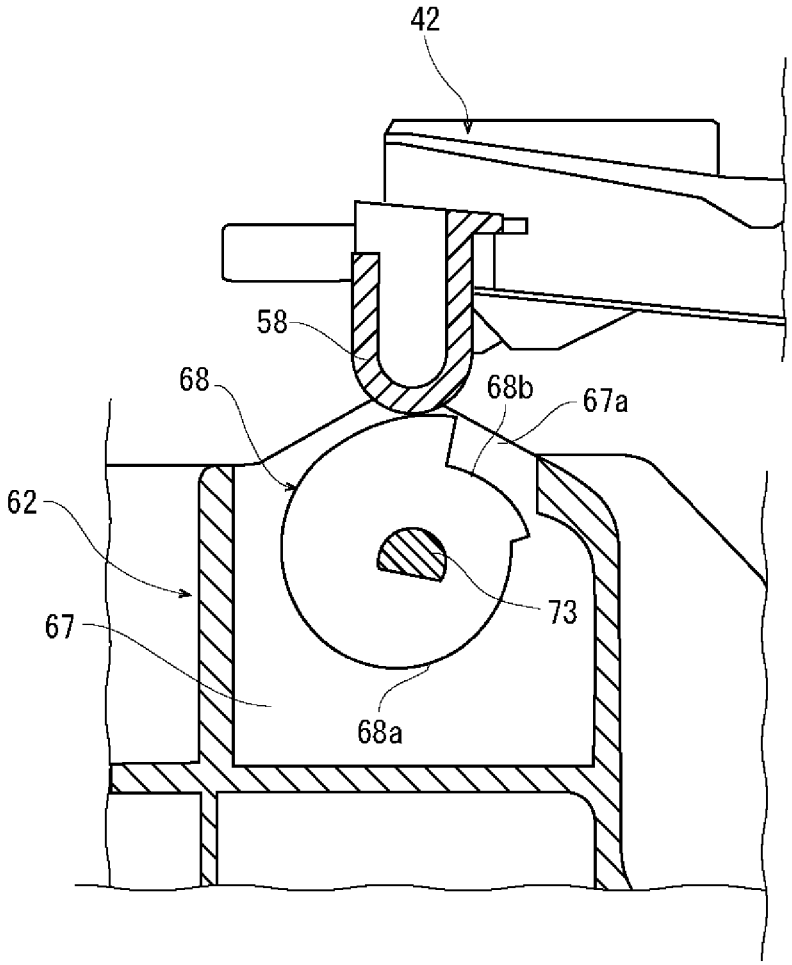
FIG. 14 illustrates the projection piece of the movable guide moved upward by the pressing portion of the sheet feed cassette in the printer according to the one embodiment.

The following describes the height change of the lower end surface of the right projection piece 58 due to the rotation of the eccentric cam 68 with reference to FIGS. 12 to 14. FIGS. 12 to 14 illustrate the right projection piece 58 and the eccentric cam 68, which are brought into abutment one another. FIG. 12 illustrates the right projection piece 58 having the normal height. FIG. 13 illustrates the right projection piece 58 having a height lower than the normal height. FIG. 14 illustrates the right projection piece 58 having a height higher than the normal height.

In a normal state illustrated in FIG. 12, as described above, the lower end surface of the right projection piece 58 is brought into abutment on the second outer peripheral surface 68*b*. When the operation member 71 rotates the eccentric cam 68 in anticlockwise direction illustrated in FIG. 12 (a direction indicated with an arrow illustrated in FIG. 12), as illustrated in FIG. 13, the lower end surface of the right projection piece 58 separates from the second outer peripheral surface 68*b* to be brought into abutment on a position near the minimum diameter position P1 on the first outer peripheral surface 68*a*. This causes the lower end surface of the right projection piece 58 to have the height lower than the normal height. When the eccentric cam 68 is further rotated in anticlockwise direction illustrated in FIG. 13, the lower end surface of the right projection piece 58 slides along the first outer peripheral surface 68*a*. This causes the lower end surface of the right projection piece 58 to gradually increase in height. Then, as illustrated in FIG. 14, when the eccentric cam 68 is rotated until the lower end surface of the right projection piece 58 reaches near the maximum diameter position P2 on the first outer peripheral surface 68*a*, this causes the lower end surface of the right projection piece 58 to have the height higher than the normal height.

Thus, the height change of the lower end surface of the right projection piece 58 changes, as illustrated in FIG. 6 with two-dot chain lines, a height to which a right end portion of the movable guide 42 is pushed up. This changes pressure abutment forces between the roller portions 53*b* of the right-side driven rollers 53, which are supported by the movable guide 42, and the right-side roller portions 45*b* of the drive roller 45, which are supported by the fixed guide 41.

The movable guide 42 and the fixed guide 41 are engaged by an engagement between the protrusion 55 and the opening 47, which are formed on respective left side plates of the movable guide 42 and the fixed guide 41, and the left projection piece 58 in the movable guide 42 is positionally aligned with respect to the abutting surface 65 in the left pressing portion 61. This holds the approximately-identical pressure abutment force between the roller portions 53*b* of the left-side driven rollers 53 in the movable guide 42 and the left-side roller portions 45*b* of the drive roller 45 in the fixed guide 41.

On the other hand, the movable guide 42 and the fixed guide 41 do not engage at a right side. As described above, in the right pressing portion 62, the height to which the movable guide 42 is pushed up by the sheet feed cassette 7 is changeable. That is, the pressure abutment forces between the roller portions 53*b* of the right-side driven rollers 53 in the movable guide 42 and the right-side roller portions 45*b* of the drive roller 45 in the fixed guide 41 are changeable.

Consequently, if an oblique feeding of the paper sheet occurs in the duplex conveying path 32, turning of the operation member 71 in the right pressing portion 62 ensures the adjustment of the pressure abutment force between the roller portions 53*b* of the right-side driven rollers 53 in the movable guide 42 and the right-side roller portions 45*b* of the drive roller 45 in the fixed guide 41. This fixes the oblique feeding of the paper sheet. Specifically, turning the operation member 71 in anticlockwise direction illustrated in FIG. 12 causes the height to which the right projection piece 58 is pushed up to gradually increase. This increases the pressure abutment force between the right-side roller portions 45*b* and 53*b*.

As described above, in the printer 1 of the disclosure, operating the operation member 71 in the sheet feed cassette 7 to rotate the eccentric cam 68 ensures the adjustment of the pressure abutment force between the respective roller portions 45*b* of the drive roller 45 and the respective roller portions 53*b* of the driven rollers 53 in the paper sheet width direction. Thus, if an oblique feeding of the paper sheet occurs in the duplex conveying path 32, the oblique feeding of the paper sheet is fixed with a simple mechanism and an easy method where the operation member 71 is held to rotate the eccentric cam 68 so as to appropriately adjust the pressure abutment force.

Furthermore, the inner and outer sidewall portions 64, which are formed in the left pressing portion 61 in the sheet feed cassette 7, regulate the left projection piece 58 in the movable guide 42 to prevent a movement to the paper sheet width direction from the abutting surface 65. This ensures the stable abutment of the left projection piece 58 and the abutting surface 65. The upper end portions 67*a* on the inner and outer sidewall portions 67, which are formed in the right pressing portion 62 in the sheet feed cassette 7, regulate the right projection piece 58 in the movable guide 42 to prevent a movement to the paper sheet width direction from the outer peripheral surface of the eccentric cam 68. This ensures the stable abutment of the right projection piece 58 and the eccentric cam 68.

Consequently, even when the printer 1 receives an impact and a vibration during storage and conveyance, the right and left projection pieces 58 in the movable guide 42 do not separate from the right and left pressing portions 62 and 61, which are in the sheet feed cassette 7. That is, the abutment states of the respective right and left projection pieces 58 and the right and left pressing portions 62 and 61 are maintained. This causes the sheet feed cassette 7 to push up the movable guide 42 for appropriately maintaining the positional relationship between the fixed guide 41 and the movable guide 42. In a state where the sheet feed cassette 7 is mounted, the positions of the right and left projection pieces 58 and the positions of the right and left pressing portions 62 and 61 are not approximately displaced in the paper sheet conveyance direction. This does not cause the right and left projection pieces 58 to move in the paper sheet conveyance direction to separate from the right and left pressing portions 62 and 61.

Both the right pressing portion 62 and the left pressing portion 61 do not have to include the inner and outer sidewall portions 67 and the inner and outer sidewall portions 64. It is possible that only the right pressing portion 62 includes the inner and outer sidewall portions 67. In this case, the sheet feed cassette 7 is smoothly mounted with the reduced interference between the movable guide 42 when mounting the sheet feed cassette 7. If a lift mechanism (not illustrated) in an elevating plate (not illustrated) on which the paper sheets are liftably placed is located at a right side of the sheet feed cassette 7, this makes a space outside in the paper sheet width direction of the right projection piece 58. The space causes a problem that the right projection piece 58 is easily dropped from the right pressing portion 62. Thus, only the right pressing portion 62 includes the inner and outer sidewall portions 67 to prevent the right projection piece 58 from dropping.

While in the embodiment the right projection piece 58 is configured to be brought into abutment on the eccentric cam 68 in the right pressing portion 62, the left projection piece 58 may be configured to be brought into abutment on the eccentric cam 68 in the left pressing portion 61. The eccentric cam 68 may have the outer peripheral surface with an appropriately-changed shape.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body;

a sheet feed cassette attachably/detachably supported by the apparatus main body; and a conveyance unit including a conveying path formed above the sheet feed cassette, the conveying path conveying a sheet in a predetermined direction; wherein the conveyance unit includes a fixed guide secured to the apparatus main body, a movable guide turnably supported around one end thereof in a sheet conveyance direction below the fixed guide, and a plurality of conveyance rollers provided on the fixed guide and the movable guide, the plurality of conveyance rollers rotating in pressure abutment with the one another to convey the sheet along the conveying path;

the conveying path is provided to be openable by the movable guide being turned downward after the sheet feed cassette is extracted from the apparatus main body;

the fixed guide includes an engaged portion provided on one side of the conveyance unit in a sheet width direction intersecting the conveyance direction;

the movable guide includes an engaging portion engageable with the engaged portion provided on the one side of the movable guide in the sheet width direction;

the sheet feed cassette includes a first and a second pressing portions provided on both sides thereof in the sheet width direction;

the movable guide further includes a first and a second pressed portions provided on both sides thereof in the sheet width direction, by the first and the second pressed portions abutting on the first and the second pressing portions, the movable guide is pushed up by the sheet feed cassette, and the movable guide is positioned with respect to the fixed guide; and the second pressing portion is provided on another side of the sheet feed cassette in the sheet width direction and includes an adjusting mechanism that adjusts pressing force against the second pressed portion of the movable guide to enable adjustment of pressure abutment force between the conveyance rollers.

2. The image forming apparatus according to claim 1, wherein:

the adjusting mechanism further includes an eccentric cam provided abutting on the second pressed portion to enable the second pressed portion to be pressed upward; and the adjusting mechanism enables adjusting pressing force of the second pressed portion with respect to the second pressing portion by rotating the eccentric cam.

3. The image forming apparatus according to claim 2, wherein the adjusting mechanism further includes an operation member to rotate the eccentric cam.

4. The image forming apparatus according to claim 2, wherein the second pressing portion further includes:

a supporting portion rotatably supporting the eccentric cam; and regulating portions provided on the supporting portion, the regulating portions maintaining a state of abutment between the second pressed portion and the eccentric cam.

5. The image forming apparatus according to claim 4, wherein:

the second pressed portion is a projection piece projecting downward in a vertical direction; and the regulating portions include a pair of sidewall portions provided on the supporting portion, spaced apart at a predetermined interval in the sheet width direction.

* * * * *